US006743991B1

(12) United States Patent
Wong et al.

(10) Patent No.: US 6,743,991 B1
(45) Date of Patent: Jun. 1, 2004

(54) POLYMERIC LIQUID METAL SWITCH

(75) Inventors: Marvin Glenn Wong, Woodland Park, CO (US); Leslie A Field, Portola Valley, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/413,094

(22) Filed: Apr. 14, 2003

(51) Int. Cl.[7] ..... H01H 29/00; H01H 29/02

(52) U.S. Cl. ..... 200/182; 200/215; 200/216; 335/47

(58) Field of Search ..... 335/47–50, 57, 335/58; 200/182, 187, 188, 189, 215, 216–219, 235, 236

(56) References Cited

U.S. PATENT DOCUMENTS

| | | | |
|---|---|---|---|
| 6,323,447 | B1 | 11/2001 | Kondoh et al. |
| 6,373,356 | B1 | 4/2002 | Gutierrez et al. |
| 6,512,322 | B1 | 1/2003 | Fong et al. |
| 6,515,404 | B1 | 2/2003 | Wong |

FOREIGN PATENT DOCUMENTS

| | | |
|---|---|---|
| JP | SHO 36-18575 | 10/1961 |
| JP | SHO 47-21645 | 10/1972 |
| JP | 9161640 A | 6/1997 |

OTHER PUBLICATIONS

Jonathan Simon, "A Liquid–Filled Microrelay with a Moving Mercury Microdrop" (Sept. 1997) Journal of Microelectromechanical Systems, vol. 6, No. 3, pp208–216.

Marvin Glenn Wong, "A Piezoelectrically Actuated Liquid Metal Switch", May 1, 2002, patent application 10/137,691, 12 pages of specification, 5 pages of claims, 1 page of abstract, and 10 sheets of drawings (Figs. 1–10).

*Primary Examiner*—Ramon M. Barrera

(57) ABSTRACT

A polymeric switch in which a switching channel is formed in a polymer layer. The channel is formed by a micromachining technique such as laser ablation or photoimaging. A liquid metal switch is contained within the switching channel. The liquid metal switch operates by making or breaking an electrical circuit using a volume of liquid metal. Electrical contact pads within the switching channel are wettable by the liquid metal and provide a latching mechanism for the switch. The polymer layer may be located between two switch substrates. Solder rings are attached to the perimeters of the switch substrates. The solder rings are wettable by solder and facilitate the creation of a hermetic seal between the substrates.

33 Claims, 5 Drawing Sheets

POLYMERIC LIQUID METAL SWITCH

CROSS REFERENCE TO RELATED APPLICATIONS

This application is related to the following co-pending U.S. Patent Applications, being identified by the below enumerated identifiers and arranged in alphanumerical order, which have the same ownership as the present application and to that extent are related to the present application and which are hereby incorporated by reference:

Application 10010448-1, titled "Piezoelectrically Actuated Liquid Metal Switch", filed May 2, 2002 and identified by Ser. No. 10/137,691;

Application 10010529-1, "Bending Mode Latching Relay", and having the same filing date as the present application;

Application 10010531-1, "High Frequency Bending Mode Latching Relay", and having the same filing date as the present application;

Application 10010570-1, titled "Piezoelectrically Actuated Liquid Metal Switch", filed May 2, 2002 and identified by Ser. No. 10/142,076;

Application 10010571-1, "High-frequency, Liquid Metal, Latching Relay with Face Contact", and having the same filing date as the present application;

Application 10010572-1, "Liquid Metal, Latching Relay with Face Contact", and having the same filing date as the present application;

Application 10010573-1, "Insertion Type Liquid Metal Latching Relay", and having the same filing date as the present application;

Application 10010617-1, "High-frequency, Liquid Metal, Latching Relay Array", and having the same filing date as the present application;

Application 10010618-1, "Insertion Type Liquid Metal Latching Relay Array", and having the same filing date as the present application;

Application 10010634-1, "Liquid Metal Optical Relay", and having the same filing date as the present application;

Application 10010640-1, titled "A Longitudinal Piezoelectric Optical Latching Relay", filed Oct. 31, 2001 and identified by Ser. No. 09/999,590;

Application 10010643-1, "Shear Mode Liquid Metal Switch", and having the same filing date as the present application;

Application 10010644-1, "Bending Mode Liquid Metal Switch", and having the same filing date as the present application;

Application 10010656-1, titled "A Longitudinal Mode Optical Latching Relay", and having the same filing date as the present application;

Application 10010663-1, "Method and Structure for a Pusher-Mode Piezoelectrically Actuated Liquid Metal Switch", and having the same filing date as the present application;

Application 10010664-1, "Method and Structure for a Pusher-Mode Piezoelectrically Actuated Liquid Metal Optical Switch", and having the same filing date as the present application;

Application 10010790-1, titled "Switch and Production Thereof", filed Dec. 12, 2002 and identified by Ser. No. 10/317,597;

Application 10011055-1, "High Frequency Latching Relay with Bending Switch Bar", and having the same filing date as the present application;

Application 10011056-1, "Latching Relay with Switch Bar", and having the same filing date as the present application;

Application 10011064-1, "High Frequency Push-mode Latching Relay", and having the same filing date as the present application;

Application 10011065-1, "Push-mode Latching Relay", and having the same filing date as the present application;

Application 10011121-1, "Closed Loop Piezoelectric Pump", and having the same filing date as the present application;

Application 10011329-1, titled "Solid Slug Longitudinal Piezoelectric Latching Relay", filed May 2, 2002 and identified by Ser. No. 10/137,692;

Application 10011344-1, "Method and Structure for a Slug Pusher-Mode Piezoelectrically Actuated Liquid Metal Switch", and having the same filing date as the present application;

Application 10011345-1, "Method and Structure for a Slug Assisted Longitudinal Piezoelectrically Actuated Liquid Metal Optical Switch", and having the same filing date as the present application;

Application 10011397-1, "Method and Structure for a Slug Assisted Pusher-Mode Piezoelectrically Actuated Liquid Metal Optical Switch", and having the same filing date as the present application;

Application 10011410-1, "Polymeric Liquid Metal Optical Switch", and having the same filing date as the present application;

Application 10011436-1, "Longitudinal Electromagnetic Latching Optical Relay", and having the same filing date as the present application;

Application 10011437-1, "Longitudinal Electromagnetic Latching Relay", and having the same filing date as the present application;

Application 10011458-1, "Damped Longitudinal Mode Optical Latching Relay", and having the same filing date as the present application;

Application 10011459-1, "Damped Longitudinal Mode Latching Relay", and having the same filing date as the present application;

Application 10020013-1, titled "Switch and Method for Producing the Same", filed Dec. 12, 2002 and identified by Ser. No. 10/317,963;

Application 10020027-1, titled "Piezoelectric Optical Relay", filed Mar 28, 2002 and identified by Ser. No. 10/109,309;

Application 10020071-1, titled "Electrically Isolated Liquid Metal Micro-Switches for Integrally Shielded Microcircuits", filed Oct. 8, 2002 and identified by Ser. No. 10/266,872;

Application 10020073-1, titled "Piezoelectric Optical Demultiplexing Switch", filed Apr. 10, 2002 and identified by Ser. No. 10/119,503;

Application 10020162-1, titled "Volume Adjustment Apparatus and Method for Use", filed Dec. 12, 2002 and identified by Ser. No. 10/317,293;

Application 10020241-1, "Method and Apparatus for Maintaining a Liquid Metal Switch in a Ready-to-Switch Condition", and having the same filing date as the present application;

Application 10020242-1, titled "A Longitudinal Mode Solid Slug Optical Latching Relay", and having the same filing date as the present application;

Application 10020473-1, titled "Reflecting Wedge Optical Wavelength Multiplexer/Demultiplexer", and having the same filing date as the present application;

Application 10020540-1, "Method and Structure for a Solid Slug Caterpillar Piezoelectric Relay", and having the same filing date as the present application;

Application 10020541-1, titled "Method and Structure for a Solid Slug Caterpillar Piezoelectric Optical Relay", and having the same filing date as the present application;

Application 10030438-1, "Inserting-finger Liquid Metal Relay", and having the same filing date as the present application;

Application 10030440-1, "Wetting Finger Liquid Metal Latching Relay", and having the same filing date as the present application;

Application 10030521-1, "Pressure Actuated Optical Latching Relay", and having the same filing date as the present application;

Application 10030522-1, "Pressure Actuated Solid Slug Optical Latching Relay", and having the same filing date as the present application; and Application 10030546-1, "Method and Structure for a Slug Caterpillar Piezoelectric Reflective Optical Relay", and having the same filing date as the present application.

FIELD OF THE INVENTION

The invention relates to the field of micro-electromechanical systems (MEMS) for electrical switching, and in particular to a polymeric liquid metal switch.

BACKGROUND OF THE INVENTION

Liquid metal switches have been devised that use the heating of gases to create pressure changes that actuate the switches by creating gaps in liquid metal drops trapped in channels (to open electrical contacts) and moving the drops to wet between contacts (to close electrical contacts). The current method used to manufacture the channel structures has resolution and accuracy limits because it uses sandblasting to form the channels. In addition, the way the heater resistors are currently formed on the ceramic substrate causes energy inefficiencies from heat loss into the ceramic substrate.

SUMMARY

The present invention relates to a polymeric switch in which a switching channel is formed in a polymer layer. The channel may be formed by micro-machining techniques such as laser ablation or photo-imaging. A liquid metal switch is contained within the switching channel. The liquid metal switch operates by making or breaking an electrical contact using a volume of liquid metal. Contact pads within the switching channel are wettable by the liquid metal and provide a latching mechanism for the switch. The switch is amenable to manufacture by micro-machining for small size.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description of the invention, which describes certain exemplary embodiments of the invention, taken in conjunction with the accompanying drawings in which:

DETAILED DESCRIPTION

Figure 1:
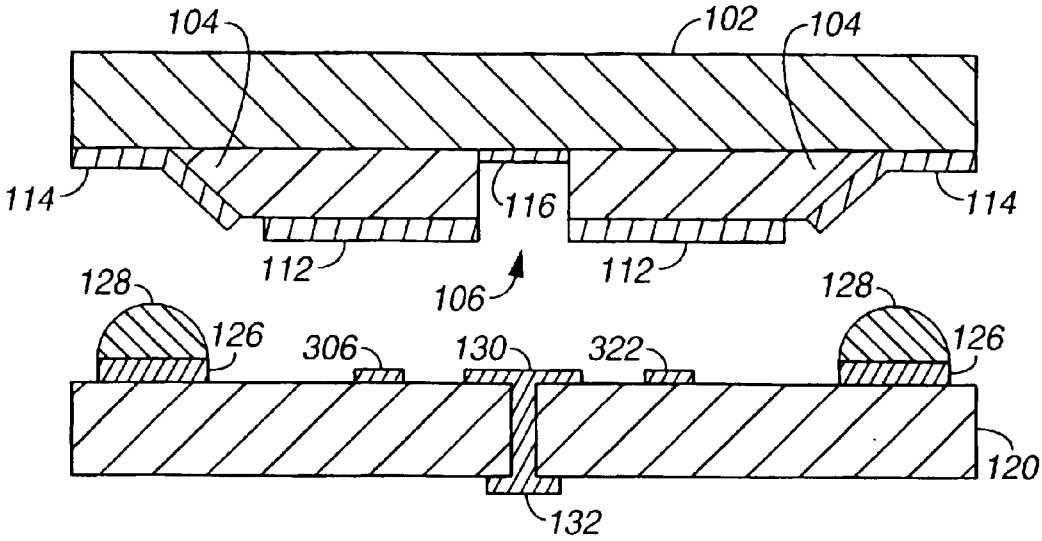
FIG. 1 is a sectional view of a self-packaged, polymeric liquid metal switch in accordance with certain embodiments of the present invention.

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described. In the description below, like reference numerals are used to describe the same, similar or corresponding parts in the several views of the drawings.

One aspect of the present invention is the use of micro-machining techniques, such as laser ablation of polyimide or other polymeric films or layers, to create a channel structure in a liquid metal switch. This method achieves better tolerances and resolution than arc achievable by sandblasting. In one embodiment, a channel layer is constructed out of Kapton (a sheet form of polyimide) or some other suitable polymeric film by laser ablating the necessary channel features into it. The channel layer is then adhered to the switch substrate using a suitable adhesive, such as Cytop or KJ (a thermoplastic polyimide with adhesive properties). Kapton is permeable to water vapor. If water vapor needs to be excluded from the resulting assembly, the assembly may be packaged for hermeticity, or it may be "self-packaged" by lamination to an impermeable support plate and sealed to the switch substrate using solder. The support plate may be made of metal, glass, silicon, or ceramic for example.

In a further embodiment, the polymeric channel layer is made by coating a support plate with a suitable liquid polymer (such as a spin-on polyimide), curing it, and then creating the desired channel structure by laser ablation. Alternatively, if the material is photo-imageable, the channel structure may be made by exposing and developing the necessary features before the material is cured. The resulting channel layer may have a layer of adhesive deposited on it by spin coating or spray coating, for example, and then photo-imaged or laser ablated. Cytop could be processed by the former process; KJ could be processed by the latter.

It is also desirable to eliminate the loss of heat from the resistors into the substrate as much as possible. This can be done by creating pockets in the surface of the switch substrate and filling them with a low thermal conductivity polymer such as polyimide before the resistors are deposited. The drive signals to the resistors may be conducted by vias through the switch substrate or by traces on top of or running through the switch substrate, for example.

In a further embodiment, loss of heat from the resistors to the substrate is reduced by using a polymer, such as polyimide, with low thermal conductivity and resistance to high temperature for the switch substrate. The resistors may be deposited directly onto the polyimide or onto intermediate layers as desired. Thinning of the polyimide under and near the heater region can be used to reduce thermal conduction and thermal capacitance in the heater area. However, this approach has the disadvantage of needing a separate package if hermeticity is desired.

FIG. 1 shows a sectional view of a self-packaged, polymeric liquid metal switch of an embodiment of the present invention. The switch in FIG. 1 is shown in two parts before final assembly. The upper part includes a channel support plate 102 covering a polymer layer 104. The channel support plate 102 may be made of a ceramic or silicon, for example. The polymer may be polyimide, for example, which is an inert plastic, resistant to high temperatures. A switching channel 106 is formed in the polymer layer. A layer of adhesive 112 covers the underside of the polymer layer 104. The adhesive may be Cytop or KJ, for example. Alternatively, the adhesive may be applied to the upper surface of the switch substrate 120 of the lower part. In a preferred embodiment, the adhesive layer is approximately 7 microns thick. An upper solder ring 114 is attached to the perimeter of the underside of the channel support plate 102 and the sides of the polymer layer 104. The upper solder ring is wettable by molten solder.

The lower part of the switch in FIG. 1 includes a switch substrate 120. The substrate may be made of ceramic for example. A lower solder ring 126 is attached to the perimeter of the inner surface of the switch substrate 120. The upper solder ring is wettable by molten solder 128. Wettable contact pads, such as that shown as 130, are also formed on the inner surface of the switch substrate 120 and align with the channel 106 in the upper part of the switch when the two parts are assembled. The wettable contact pad 130 is wettable by a liquid metal, such as mercury, which is used to provide a latching mechanism in the switch. In a preferred embodiment the contact is approximately 8000 Å thick. The contact pad 130 is connected though a via in the switch substrate 120 to a solder pad 132 on the underside of the switch substrate. In a further embodiment, the contact pads can be connected to the edge of the circuit substrate via traces deposited on the upper surface of the switch substrate. Optionally, additional contact pads, such as 116, may be fixed to the channel support plate 102. Electrical conductors 306 and 322 are coupled to heaters, which will be described below.

Figure 2:
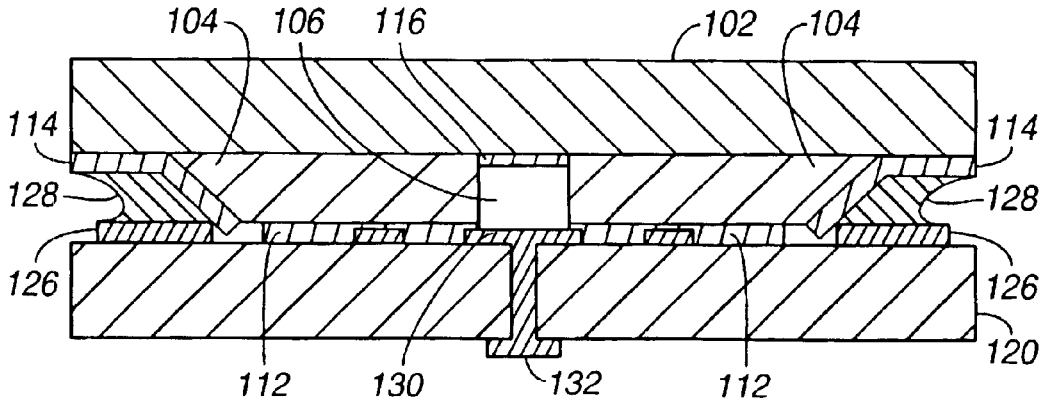
FIG. 2 shows a sectional view of an assembled switch in accordance with certain embodiments of the present invention.

FIG. 2 shows a sectional view of the assembled switch. The adhesive layer 112 bonds the polymer layer 104 to the switch substrate 120 and creates a cavity 106 within the switch. The wettable electric contact pad 130 is positioned on one side of the cavity 106. The solder 128 is drawn by surface tension to fill the gap between the upper solder ring 114 and the lower solder ring 126. This provides a reliable hermetic seal for the interior of the switch. Provided there is sufficient solder, the wettable solder rings guarantee that the seal will be complete.

Figure 3:
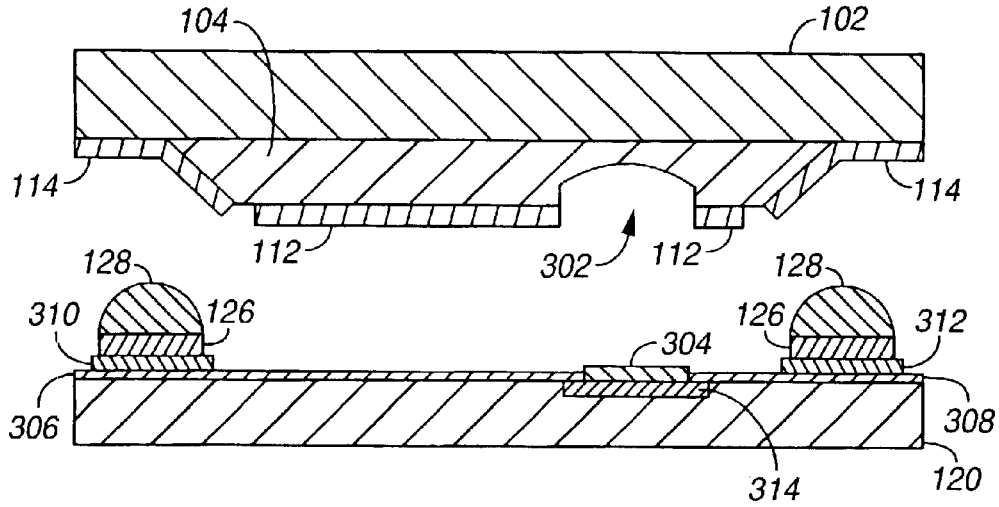
FIG. 3 shows a further sectional view of a polymeric liquid metal switch in accordance with certain embodiments of the present invention.

FIG. 3 shows a further sectional view of a polymeric switch of the present invention. The polymer layer 104 in the upper part contains a heater cavity 302. A heater 304, such as a resistor, is positioned on the inner surface of the switch substrate 120 and is aligned with the heater cavity 302. When the two parts are assembled, the heater is inside the heater cavity. Electrical conductors 306 and 308 provide electrical connections to the heater. In operation, a voltage is applied across the heater and the gas in the heater cavity is heated, causing an increase in pressure and volume of the gas. Insulation layers 310 and 312 provide electrical insulation between the electrical conductors 306 and 308 and the solder ring 126. The layers may be, for example, spin-on glass or a thin film passivation layer such as SiNx or SiO2. The layer is preferably thin enough that it does not impede the creation of the solder joint between the solder rings. A polymer layer 314 (such as a polyimide layer) separates the heater 304 from the switch substrate 120 and reduces heat loss to the substrate.

Figure 4:
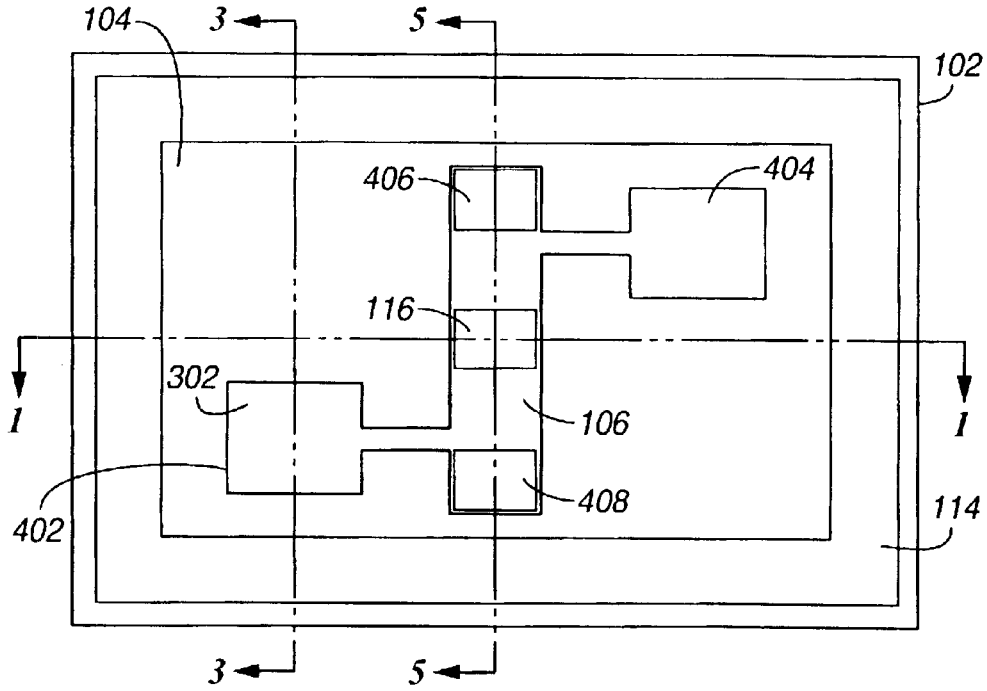
FIG. 4 is a view of the inner surface of a channel support plate in accordance with certain embodiments of the present invention.

FIG. 4 is a view of the under side of the channel support plate 102. The upper solder ring 114 is attached to the perimeter of the inner surface of the channel support plate 102. A channel 402 is contained in the polymer layer 104. The adhesive 112 is not shown in this view. Within the channel are heater cavities, 302 and 404, and switching channel 106. Within the switching channel 106 are three contact pads 406, 116 and 408. The surfaces of the contact pads are wettable by liquid metal. Optionally, electrical connections may be made to one or more of these contact pads rather than to contact pads on the switch substrate 120. The section 1—1 is shown as the upper part in FIG. 1. The section 3—3, rotated by 90°, is shown as the upper part in FIG. 3. The section 5—5, rotated by 90°, is shown as the upper part in FIG. 5.

Figure 5:
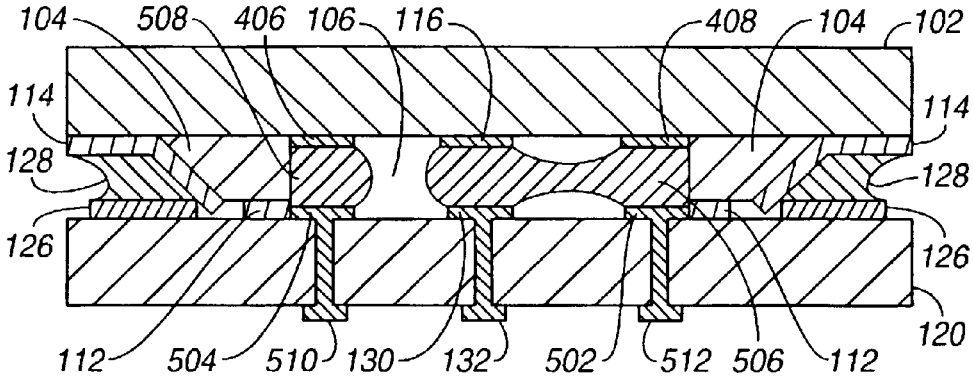
FIG. 5 is a sectional view of an assembled polymeric switch in a first switch state.
Figure 6:
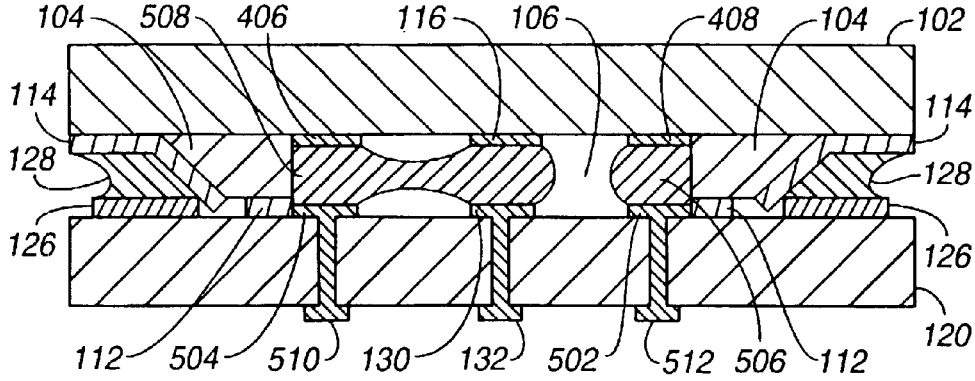
FIG. 6 is a sectional view of an assembled polymeric switch in a second switch state.

FIG. 5 is a sectional view through the section 5—5 of the assembled polymeric switch in FIG. 4. Within the switching channel 106 are upper contact pads 406, 116 and 408, and corresponding lower contact pads 502, 130 and 504. The upper and lower contacts may be coupled to form contact rings. Also contained in the switching channel is a volume of liquid metal, shown as two liquid metal volumes 506 and 508. The liquid metal volumes are held in contact with the contact pads by the surface tension of the liquid metal. The wettable contact pads and the surface tension of the liquid metal provide a latching mechanism for the switch. With the liquid metal distributed as shown in FIG. 5, an electrical connection is made between the contact pads 130 and 504, while there is no connection between contact pads 130 and 502. When a voltage is applied to the heater (304 in FIG. 3), the pressure in the heater cavity (302 in FIG. 3) is increased. The heater cavity is coupled to the switching cavity 106, and the pressure in the right hand end of the switching cavity in FIG. 5 is also increased. The increased pressure overcomes the surface tension and breaks the liquid metal bond between the contact pads 408 and 504 and the contact pads 116 and 130. Some of the liquid metal is moved along the switching channel and coalesces with the liquid metal volume 508. In this manner, the electrical connection between contact pads 130 and 504 (or 116 and 408) is broken, while the connection between contact pads 130 and 502 (or 116 and 406) is completed. The resulting switched state is shown in FIG. 6. When a voltage is applied to a corresponding healer in heater cavity 404 (shown in FIG. 4), the switch-state is reversed.

Figure 7:
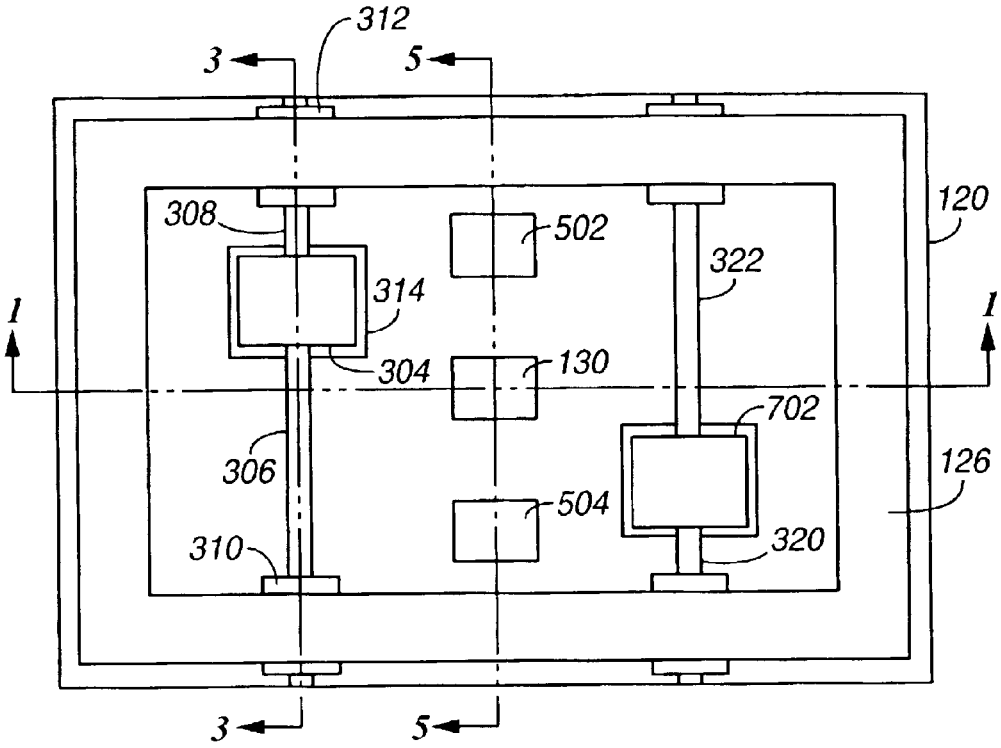
FIG. 7 is a view of the inner surface of a switch substrate in accordance with certain embodiments of the present invention.

FIG. 7 is a view of the inner surface of the lower part of the switch, i.e. the upper surface of the switch substrate 120. The lower solder ring 126 covers the perimeter of the switch substrate 120. The solder itself is not shown in this view. Heater 304 is positioned on the substrate so as to align with the heater cavity 302 (shown in FIG. 3 and FIG. 4) when the switch is assembled. Heater 702 is positioned on the substrate so as to align with the heater cavity 404 (shown in FIG. 4) when the switch is assembled. Heater connections 306 and 308 extend from the heater 304 to the edges of the substrate, so that an electrical voltage can be applied to the heater. Alternatively, the heater connections could be passed through vias in the switch substrate. Insulation layers 310 and 312 isolate the heater connections from the solder ring 126. A polymer layer 314 separates the heater 304 from the switch substrate 120. Corresponding connections (320 and 322) and insulation layers are used to connect the second heater 702 to the edge of the substrate. Contact pads 502, 130 and 504 have a surface that is wettable by the liquid metal in the switching chamber. The section 1—1 is shown as the lower part in FIG. 1. The section 3—3, rotated by 90°, is shown as the lower part in FIG. 3. The section 5—5, rotated by 90°, is shown as the lower part in FIG. 5.

Figure 8:
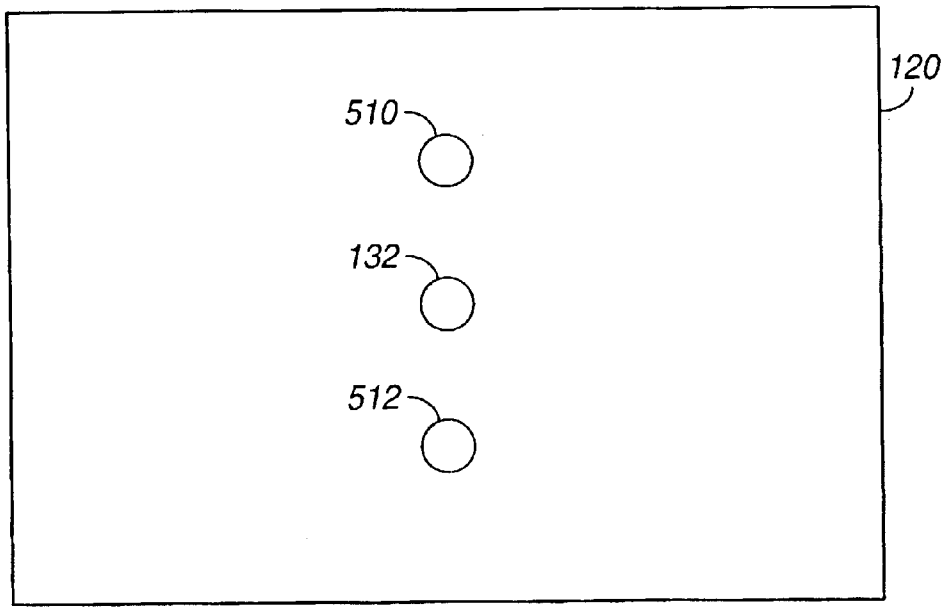
FIG. 8 is a view of the outer surface of a switch substrate in accordance with certain embodiments of the present invention.

FIG. 8 is a view of the outer surface of the switch substrate 120. The solder pads or electrical connectors 510, 132 and 512 allow signals to be connected to the switch through vias in the circuit substrate. In a further embodiment, one or more of the electrical connectors is placed on the outer surface of the channel support plate. In a still further embodiment, the connectors are positioned at the edges of the switch and are coupled to the contact pads via conducting tracks deposited in the circuit substrate.

Figure 9:
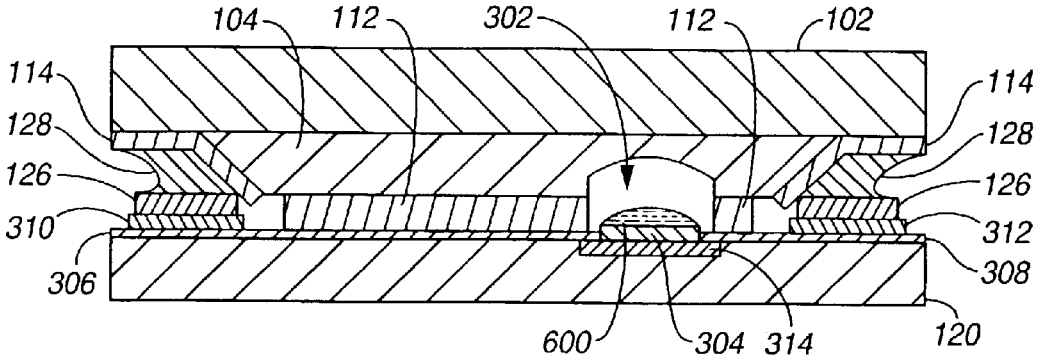
FIG. 9 shows a sectional view of a polymeric liquid metal switch utilizing a state-change liquid in accordance with certain embodiments of the present invention.

FIG. 9 shows a further sectional view of a polymeric switch of the present invention. The polymer layer 104 contains a heater cavity 302. A heater 304, such as a resistor, is positioned on the inner surface of the switch substrate 120 within the heater cavity 302. A phase-change liquid 600 is in wetted contact with the heater. Electrical conductors 306 and 308 provide electrical connections to the heater. In operation, a voltage is applied across the heater and the phase-change liquid 600 changes from a liquid state to a gas state. The associated increase in volume causes an increase in the pressure of the gas and activates the switch as described above. When the heater cools, the phase-change liquid 600 condenses onto the surface of the heater 304. A corresponding phase-change liquid is contained in a second heater cavity (304 in FIG. 4). The phase-change liquid may be, for example, an inert, inorganic liquid or a liquid metal.

While the invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims.

What is claimed is:

1. A polymeric switch comprising:

a polymer layer;

a switching channel formed in the polymer layer;

a switch substrate having an inner surface and an outer surface, the inner surface being attached to the polymer layer;

first and second electrical connectors; and, a liquid metal switch contained within the switching channel and operable to make or break an electrical circuit between the first and second electrical connectors.

2. A polymeric switch in accordance with claim 1, further comprising a layer of adhesive between the switch substrate and the polymer layer.

3. A polymeric switch in accordance with claim 1, further comprising a channel support plate having an inner surface and an outer surface, the inner surface of the channel support plate being attached to the polymer layer so that the polymer layer lies between the channel support plate and the switch substrate.

4. A polymeric switch in accordance with claim 3, wherein the channel support plate and the switch substrate are ceramic.

5. A polymeric switch in accordance with claim 3, further comprising an hermetic seal between the channel support plate and the switch substrate, the hermetic seal, the channel support plate and the switch substrate enclosing the polymer layer.

6. A polymeric switch in accordance with claim 5, wherein the hermetic seal comprises:

a first solder ring attached to the perimeter of the inner surface of the channel support plate and surrounding the polymer layer;

a second solder ring attached to the perimeter of the inner surface of the switch substrate; and a solder joint connecting the first and second solder rings.

7. A polymeric switch in accordance with claim 6, wherein the first and second solder rings are wettable by molten solder.

8. A polymeric switch in accordance with claim 1, wherein the liquid metal switch comprises:

a first outer contact pad located in the switching channel and having a surface wettable by a liquid metal;

a second outer contact pad located in the switching channel and having a surface wettable by a liquid metal;

a middle contact pad located in the switching channel between the first and second outer contact pads and having a surface wettable by a liquid metal;

a first liquid metal volume contained within the switching cavity and in wetted contact with the first outer contact pad;

a second liquid metal volume contained within the switching cavity and in wetted contact with the second outer contact pad; and a third liquid metal volume contained within the switching cavity and in wetted contact with the middle contact pad;

wherein the third liquid metal volume is adapted to coalesce with one of the first liquid metal volume and the second liquid metal volume.

9. A polymeric switch in accordance with claim 8, wherein the first electrical connector is electrically coupled to the first outer contact pad and the second electrical connector is electrically coupled to the middle contact pad.

10. A polymeric switch in accordance with claim 8, wherein the liquid metal switch further comprises:

a first heater cavity formed in the polymer layer and coupled to the switching channel;

a second heater cavity formed in the polymer layer and coupled to the switching channel;

a first heater positioned in the first heater cavity and adapted to heat a fluid in the first cavity; and a second heater positioned in the second heater cavity and adapted to heat a fluid in the second cavity;

wherein operation of the first heater causes the third liquid metal volume to coalesce with the first liquid metal volume and operation of the second heater causes the third liquid metal volume to coalesce with the second liquid metal volume.

11. A polymeric switch in accordance with claim 10, further comprising:

a first phase-change liquid in wetted contact with the first heater and adapted to change phase when the first heater is energized; and a second phase-change liquid in wetted contact with the second heater and adapted to change phase when the second heater is energized.

12. A polymeric switch in accordance with claim 11, wherein the first and second phase-change liquids are inert, inorganic liquids.

13. A polymeric switch in accordance with claim 11, wherein the first and second phase-change liquids are liquid metals.

14. A polymeric switch in accordance with claim 10, further comprising:

a first heater connection formed on the inner surface of the switch substrate and electrically connected to the first heater; and a second heater connection formed on the inner surface of the switch substrate and electrically connected to the second heater.

15. A polymeric switch in accordance with claim 10, wherein at least one of the first heater and the second heater is separated from the switch substrate by a pad having a low thermal conductivity.

16. A polymeric switch in accordance with claim 15, wherein the pad having a low thermal conductivity is made of a polymer material.

17. A polymeric switch in accordance with claim 8, wherein the first and second outer contact pads and the middle contact pad are fixed to the inner surface of the switch substrate.

18. A polymeric switch in accordance with claim 8, further comprising a channel support plate having an inner surface and an outer surface.

19. A polymeric switch in accordance with claim 18, wherein the first and second outer contact pads and the middle contact pad are fixed to the inner surface of the channel support plate.

20. A polymeric switch in accordance with claim 18, wherein at least one of the first outer contact pad, the second outer contact pad and the middle contact pad comprises a pair of contact pads, one of the pair of contact pads being fixed to the inner surface of the channel support plate and the other being fixed to the inner surface of the switch substrate.

21. A polymeric switch in accordance with claim 18, wherein at least one of the first outer contact pad, the second outer contact pad and the middle contact pad comprises contact ring attached to the walls of the switching channel.

22. A polymeric switch in accordance with claim 8, further comprising a third electrical connector coupled to the second outer contact pad, wherein the liquid metal switch is further operable to make or break an electrical circuit between the third and second electrical connectors.

23. A polymeric switch in accordance with claim 1, wherein the polymer layer is composed of polyimide.

24. A polymeric switch in accordance with claim 1, wherein the switch substrate is composed of a polymer.

25. A polymeric switch in accordance with claim 1, produced by a method of micro-machining.

26. A method for manufacturing a polymeric switch, the method comprising:

forming a plurality of electrical contact pads on a switch substrate;

forming a heater on the switch substrate;

forming a channel structure in a layer of polymer, the channel structure having a switching channel and a heater cavity coupled to the switching channel;

placing a volume of liquid metal on at least one of the plurality of contact pads; and attaching the switch substrate to the polymer layer, such that the heater is in the heater cavity and the plurality of contact pads are in the switching cavity.

27. A method in accordance with claim 26, wherein the channel structure in the layer of polymer is formed by micro-machining.

28. A method in accordance with claim 27, wherein the channel structure in a layer of polymer is formed by laser ablation of the layer of polymer.

29. A method in accordance with claim 28, wherein the polymer layer is formed on a channel support plate.

30. A method in accordance with claim 29, further comprising:

attaching a first solder ring to the perimeter of the inner surface of the channel support plate, the first solder ring being wettable by molten solder;

attaching a second solder ring to the perimeter of the inner surface of a switch substrate, the second solder ring being wettable by molten solder; and soldering the first solder ring to the second solder ring to form a seal around the polymer layer.

31. A method in accordance with claim 29, wherein forming the channel structure in the layer of polymer comprises:

coating the channel support plate with a liquid polymer;

curing the liquid polymer; and ablating the polymer using a laser to form the channel structure.

32. A method in accordance with claim 28, wherein forming the channel structure in the layer of polymer comprises:

covering a surface of the channel support plate with a polymer; and forming the channel structure by photo-imaging.

33. A method in accordance with claim 26, wherein the attaching the switch substrate to the polymer layer comprises:

applying a layer a adhesive to at least one of the polymer layer and the switch substrate; and bringing the polymer layer and the switch substrate into contact.

* * * * *

UNITED STATES PATENT AND TRADEMARK OFFICE

CERTIFICATE OF CORRECTION

PATENT NO. : 6,743,991 B1 
DATED : June 1, 2004
INVENTOR(S) : Marvin Glenn Wong and Leslie A. Field It is certified that error appears in the above-identified patent and that said Letters Patent is hereby corrected as shown below:

Column 10,
Line 26, after "with claim", delete "27" and insert therefor -- 26 --
Line 29, after "with claim", delete "28" and insert therefor -- 26 --
Line 48, after "with claim", delete "28" and insert therefor -- 29 --

Signed and Sealed this

Twenty-third Day of November, 2004

JON W. DUDAS
*Director of the United States Patent and Trademark Office*